US006588872B2

(12) United States Patent
Anderson et al.

(10) Patent No.: US 6,588,872 B2
(45) Date of Patent: Jul. 8, 2003

(54) ELECTRONIC SKEW ADJUSTMENT IN AN INK JET PRINTER

(75) Inventors: Frank Edward Anderson, Lexington, KY (US); William Paul Cook, Lexington, KY (US); George Keith Parish, Winchester, KY (US); Susan Marie Zearfoss, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 74 days.

(21) Appl. No.: 09/827,805

(22) Filed: Apr. 6, 2001

(65) Prior Publication Data

US 2002/0145640 A1 Oct. 10, 2002

(51) Int. Cl.[7] ..... B41J 2/07
(52) U.S. Cl. ..... 347/19
(58) Field of Search ..... 347/9, 19, 14

(56) References Cited

U.S. PATENT DOCUMENTS

| | | | |
|---|---|---|---|
| 4,059,183 | A | 11/1977 | Hoskins |
| 4,626,867 | A | 12/1986 | Furukawa et al. |
| 4,709,245 | A | 11/1987 | Piatt |
| 4,961,088 | A | 10/1990 | Gilliland et al. |
| 5,021,828 | A | 6/1991 | Yamaguchi et al. |
| 5,049,898 | A | 9/1991 | Arthur et al. |
| 5,132,711 | A | 7/1992 | Shinada et al. |
| 5,138,344 | A | 8/1992 | Ujita |
| 5,250,956 | A | 10/1993 | Haselby et al. |
| 5,253,020 | A | 10/1993 | Matsushita et al. |

(List continued on next page.)

FOREIGN PATENT DOCUMENTS

| | | |
|---|---|---|
| JP | 62290567 | 12/1987 |
| WO | WO 00/06386 | 2/2000 |

OTHER PUBLICATIONS

IBM Technical Disclosure Bulletin. Inkjet Velocity Error Compensation. Nov. 1975 p. 1983.
IBM Technical Disclosure Bulletin. Control Logic Compensation for Mechanical Variance. Apr. 1976. p. 3823.
IBM Technical Disclosure Bulletin. Improvement to Time Correction System For Multi–Nozzle Ink Jet Printer to Increase Allowable Transit Error. Mar. 1979. pp. 4250–4253.
IBM Technical Disclosure Bulletin. Control Algorithm For Improved Print Registration. Mar. 1986. pp. 4386–4390.
IBM Technical Disclosure Bulletin. Bi–Directional Print Alignment Ease–of–Use. Sep. 1990.

*Primary Examiner*—Huan Tran
(74) *Attorney, Agent, or Firm*—Luedeka, Neely & Graham P.C.; Michael T. Sanderson, Esq.; Scott N. Barker, Esq.

(57) ABSTRACT

A system is described for compensating for misalignments in an ink jet printer having an ink jet print head cartridge that includes a heater chip. The system includes determining alignment adjustment information related to the misalignments in the ink jet printer, loading the alignment adjustment information into a volatile memory device on the heater chip, and accessing the alignment adjustment information from the volatile memory device. The system also includes generating nozzle control signals based at least in part on the alignment adjustment information. The nozzle control signals are selectively provided to resistive heating elements in the heater chip, thereby heating ink in ink chambers adjacent the heating elements and ejecting ink droplets toward a print medium. The timing of the nozzle control signals is adjusted based upon the amount of misalignment in the various components of the printer and print head. The timing adjustments are applied to groups of nozzles so that dots printed by one group are substantially vertically aligned with dots printed by another group, thereby reducing the amount of perceptible skew in the printed output.

11 Claims, 7 Drawing Sheets

U.S. PATENT DOCUMENTS 5,272,503 A 12/1993 LeSueur et al.
5,278,577 A 1/1994 Kitsuki
5,283,613 A 2/1994 Midgley, Sr.
5,289,208 A 2/1994 Haselby
5,297,017 A 3/1994 Haselby et al.
5,363,134 A 11/1994 Barbehenn et al.
5,365,312 A 11/1994 Hillmann et al.
5,410,641 A 4/1995 Wakabayashi et al.
5,452,059 A 9/1995 Sekiya
5,455,617 A 10/1995 Stephenson et al.
5,486,899 A 1/1996 Iimori et al.
5,491,540 A 2/1996 Hirst
5,506,611 A 4/1996 Ujita et al.
5,519,418 A 5/1996 Nishikawa et al.
5,534,895 A 7/1996 Lindenfelser et al.
5,610,635 A 3/1997 Murray et al.
5,636,032 A 6/1997 Springett
5,646,660 A 7/1997 Murray
5,655,174 A 8/1997 Hirst
5,694,156 A 12/1997 Hoisington et al.
5,699,091 A 12/1997 Bullock et al.
5,708,912 A 1/1998 Lee
5,751,305 A 5/1998 Hadley
5,777,638 A 7/1998 Salter et al.
5,847,722 A 12/1998 Hackleman
5,956,055 A 9/1999 Gibson et al.
5,969,729 A * 10/1999 Erickson et al. ..... 347/9
6,000,773 A 12/1999 Murray et al.
6,019,449 A * 2/2000 Bullock et al. ..... 347/19

* cited by examiner

ELECTRONIC SKEW ADJUSTMENT IN AN INK JET PRINTER

FIELD OF THE INVENTION

The present invention is generally directed to ink jet printers. More particularly, the invention is directed to a system for improving print quality by compensating for misalignment or skew between various components in an ink jet printer.

BACKGROUND OF THE INVENTION

Many ink jet printers form printed images on a print medium by ejecting droplets of ink from ink nozzles on a print head as the print head is scanned across the print medium. Ink droplets are formed and ejected from the nozzles when the ink is super-heated by resistive heating elements disposed on a heater chip in the print head. Typically, the print head rides on a carriage that scans the print head horizontally across the print medium to print a swath of the image. At the end of a swath, the print medium is advanced by the width of the swath, and the print head is again scanned across the print medium to print the next swath of the image.

Typically the nozzles on the print head form an array that is aligned perpendicular to the scan direction. The length of the array generally defines the width of the swath. If the nozzle array is not perfectly perpendicular to the scan direction, visible print defects may occur at each swath-to-swath boundary in the printed image. This problem is more pronounced as nozzle counts and swath widths increase.

Several factors contribute to misalignment between the nozzle array and the scan direction. These include misalignments between the heater chip and the body of the print head cartridge, and between the print head cartridge and the carriage rail.

This problem has been addressed mechanically by attempting to maintain manufacturing tolerances to keep misalignments within an acceptable range. However, this approach requires expensive precision components and equipment to manufacture both the print head and the carriage. Prior attempts at electronic timing adjustments to compensate for the misalignment have proven to be cost prohibitive and size prohibitive due to large amounts of logic required per nozzle.

Therefore, a system is needed for adjusting the timing of ink ejection from nozzles or groups of nozzles in a manner that reduces swath-to-swath skew to an imperceptible level, while taking into account mechanical, electrical, fluid flow, and cost restraints.

SUMMARY OF THE INVENTION

The foregoing and other needs are met by a method for compensating for misalignments in an ink jet printer having an ink jet print head cartridge that includes a heater chip. The method includes determining alignment adjustment information related to the misalignments in the ink jet printer, loading the alignment adjustment information into a volatile memory device on the heater chip, and accessing the alignment adjustment information from the volatile memory device. The method also includes generating nozzle control signals based at least in part on the alignment adjustment information. The nozzle control signals are selectively provided to resistive heating elements in the heater chip, thereby heating ink in ink chambers adjacent the heating elements and ejecting ink droplets toward a print medium.

The timing of the nozzle control signals is adjusted based upon the amount of misalignment in the various components of the printer and print head. Preferably, the timing adjustments are applied to groups of nozzles so that dots printed by one group are substantially vertically aligned with dots printed by another group, thereby reducing the amount of perceptible skew in the printed output.

Preferred embodiments of the method include the steps of storing heater chip alignment information in a print head memory device on the ink jet print head cartridge, and storing print head alignment information in a printer memory device in the ink jet printer. In these embodiments, the alignment adjustment information is determined based at least in part on the heater chip alignment information stored in the print head memory device and the print head alignment information stored in the printer memory device.

In another aspect, the invention provides an ink jet printer for forming printed images on a print medium based on print data. The printer includes a carriage that is movable in a first direction relative to the print medium, and an ink jet print head cartridge mounted on the carriage. The print head cartridge includes a cartridge housing that is mechanically coupled to the carriage, where the cartridge housing is oriented with respect to the carriage according to a print head alignment angle. The cartridge also includes an ink jet heater chip oriented with respect to the cartridge housing according to a heater chip alignment angle. The ink jet heater chip has an array of resistive ink-heating elements, and a heater chip memory device for receiving alignment adjustment information. The print head cartridge further includes a print head memory device for storing heater chip alignment information related to the heater chip alignment angle. An array of ink-ejection nozzles is provided on the print head cartridge corresponding to the array of ink-heating elements.

The printer includes a printer controller having a printer memory device for storing print head alignment information related to the print head alignment angle. The printer controller incorporates control electronics that are electrically coupled to the heater chip memory device, the print head memory device, and the printer memory device. The control electronics access the print head memory device to retrieve the heater chip alignment information, access the printer memory device to retrieve the print head alignment information, determine the alignment adjustment information based at least in part on the heater chip alignment information and the print head alignment information, and provide the alignment adjustment information to the heater chip memory device.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
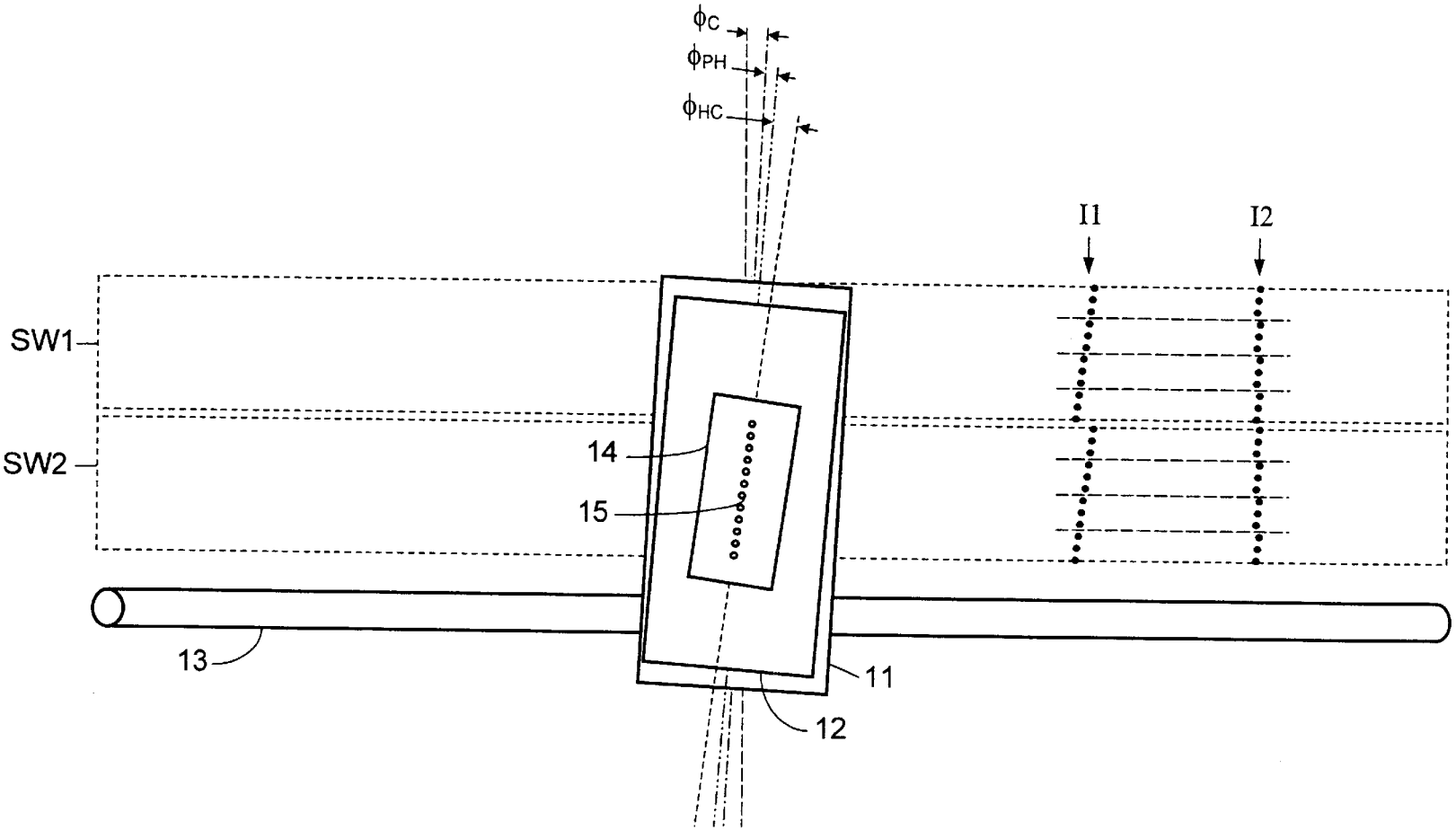
FIG. 1 depicts misalignments between an ink jet heater chip, an ink jet print head cartridge, a printer carriage, and a carriage rail in an ink jet printer.

FIG. 1 illustrates the problem addressed by the present invention. As shown in FIG. 1, an ink jet print head cartridge 12 is attached to a carriage 11 which rides along a rail 13. Due to mechanical imperfections in various mating surfaces of the carriage 11 and the print head 12, the print head 12 and the carriage 11 may be misaligned. The misalignment between the carriage 11 and the print head 12 may be characterized by a print head alignment angle $\phi_{PH}$. Due to mechanical imperfections in the attachment of the carriage 11 to the rail 13, the carriage 11 and the rail 13 may also be misaligned. The misalignment between the carriage 11 and the rail 13 may be characterized by a carriage alignment angle $\phi_C$. On the print head 12 is an ink jet heater chip 14 which contains an array of ink heating elements associated with an array of ink ejection nozzles 15. The heater chip 14, and consequently the array of nozzles 15, may be misaligned relative to the print head 12 as indicated by the heater chip alignment angle $\phi_{HC}$.

FIG. 1 also depicts a pair of images I1 and I2 printed by the print head 12 during two passes of the print head 12 across a print medium. The upper portion of each image I1 and I2 is printed as part of a first print swath SW1, and the lower portion of each image I1 and I2 is printed as part of a second print swath SW2. Image I1 is printed with no compensation for the various misalignments between the carriage 11, print head 12, and heater chip 14. Due to the various misalignments, the dots formed by the ink droplets are not vertically aligned. Rather, the dots are skewed from vertical according to a misalignment or skew angle that is the sum of $\phi_C$, $\phi_{PH}$, and $\phi_{HC}$. Due to this skew, there is a substantial discontinuity where the upper and lower portions of the image I1 meet.

Image I2 is printed with compensation applied according to a preferred embodiment of the invention. As described in more detail below, the invention adjusts the timing of ejection of ink droplets for groups of the nozzles 15 to minimize the visually perceptible effect of the skew.

Figure 2:
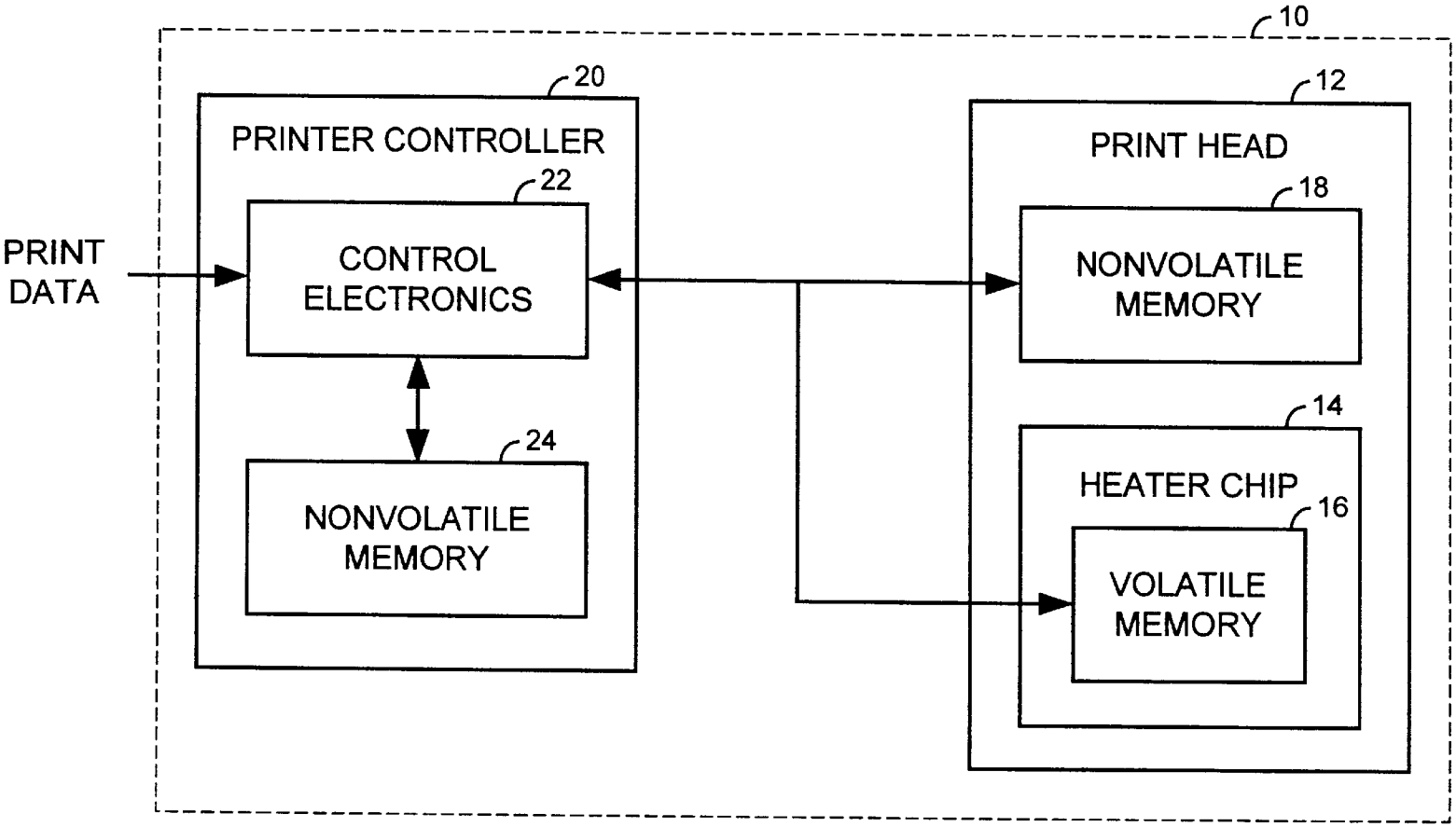
FIG. 2 is a functional block diagram of an ink jet printer which electronically compensates for misalignments between various components in the printer according to a preferred embodiment of the invention.

Shown in FIG. 2 is a functional block diagram of a preferred embodiment of an ink jet printer 10 which implements skew control to cure the problem depicted in image I1 of FIG. 1. The printer 10 includes the print head 12 containing the heater chip 14. As described in more detail below, the heater chip 14 includes logic circuits, resistive heating elements, and driver devices for driving the heating elements. The heater chip 14 also includes a memory device 16, such as volatile random access memory registers, for storing skew adjustment data. Although the memory 16 of the preferred embodiment is volatile memory, it will be appreciated that the memory 16 could also be a non-volatile memory device. The print head 12 preferably includes non-volatile memory 18 for storing skew adjustment information related to the skew angle $\phi_{HC}$.

Within the printer 10 is a printer controller 20 that receives print data, such as from a host computer, formats the print data for each print swath, and provides the print data to the print head 12. The controller 20 includes control electronics 22 that, among other things, format the print data and calculate skew adjustment data, as described below. The controller 20 preferably also includes non-volatile memory 24 for storing skew adjustment information related to the skew angles $\phi_{PH}$ and $\phi_C$. It will be appreciated by those skilled in the art that printer controller 20, including its control electronics 22 and non-volatile memory 24, may alternatively be locally or remotely associated with the host computer.

Figure 6:
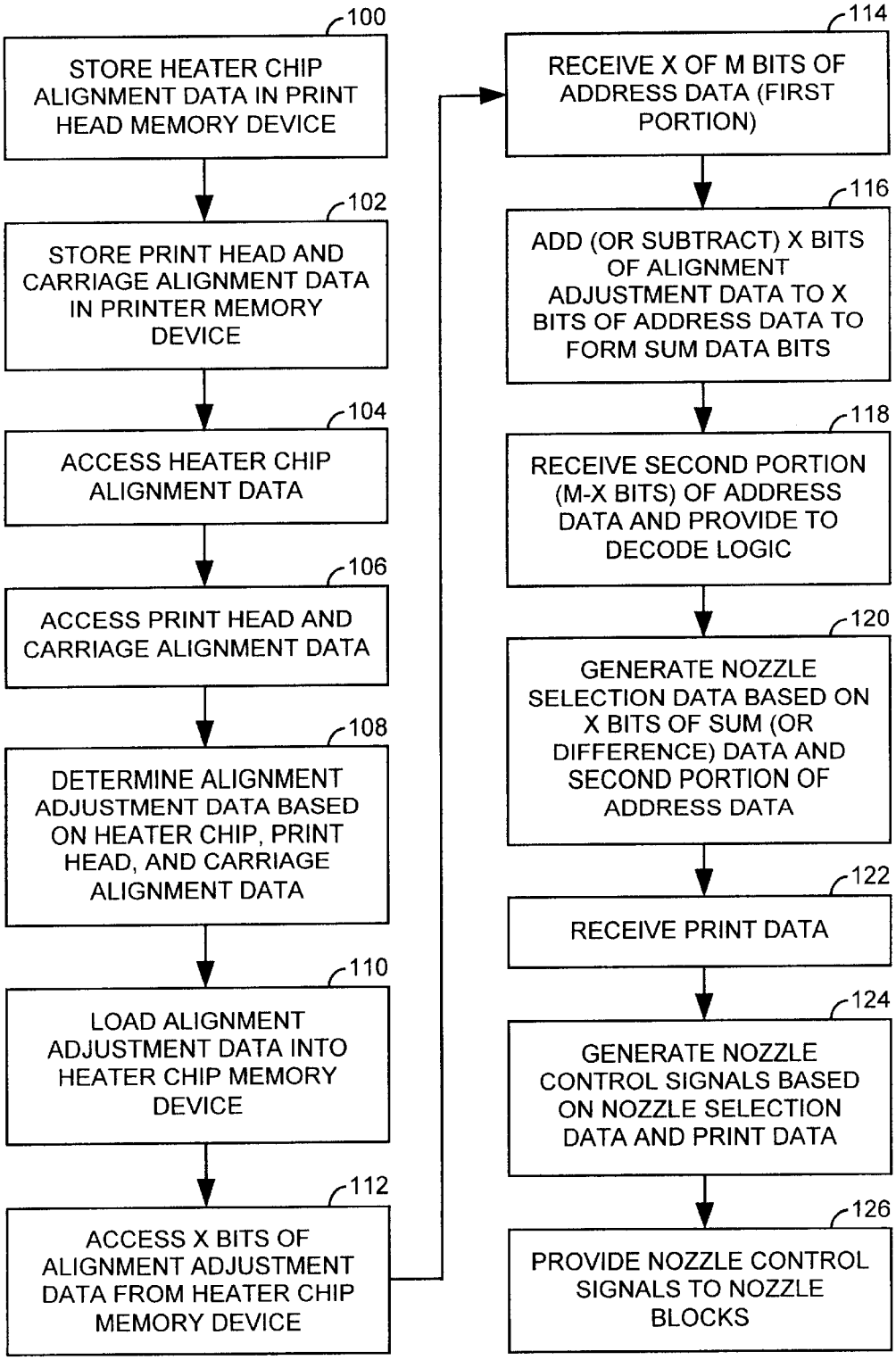
FIG. 6 is a functional flow diagram of a method for compensating for misalignments between various components in an ink jet printer according to a preferred embodiment of the invention.

According to a preferred embodiment of the invention as depicted in the block diagram of FIG. 2 and the flow diagram of FIG. 6, during or after the manufacture of the print head 12, a measurement is made to characterize the alignment angle $\phi_{HC}$ between the heater chip 14 and the print head 12. A value, such as an angular value corresponding to the heater chip alignment angle $\phi_{HC}$, is then stored in the nonvolatile memory device 18 on the print head 12 (step 100). Similarly, during the manufacture of the printer 10, measurements are made to characterize the misalignment angle $\phi_C$ between the rail 13 and the carriage 11, and the misalignment angle $\phi_{PH}$ between the carriage 11 and the print head 12, respectively. Values, such as angular values corresponding to the carriage and print head alignment angles $\phi_C$ and $\phi_{PH}$, are then stored in the nonvolatile memory device 24 in the printer controller 20 (step 102).

In the preferred embodiment, when the printer 10 is powered on, the controller 20 accesses the data stored in the print head memory device 18 related to the heater chip alignment angle $\phi_{HC}$ (step 104), and accesses the data stored in the printer memory device 24 related to the carriage and print head alignment angles $\phi_C$ and $\phi_{PH}$ (step 106). The controller 20 then determines the skew adjustment data based on the heater chip alignment angle $\phi_{HC}$, the carriage alignment angle $\phi_C$, and the print head alignment angle $\phi_{PH}$ (step 108).

Figure 3:
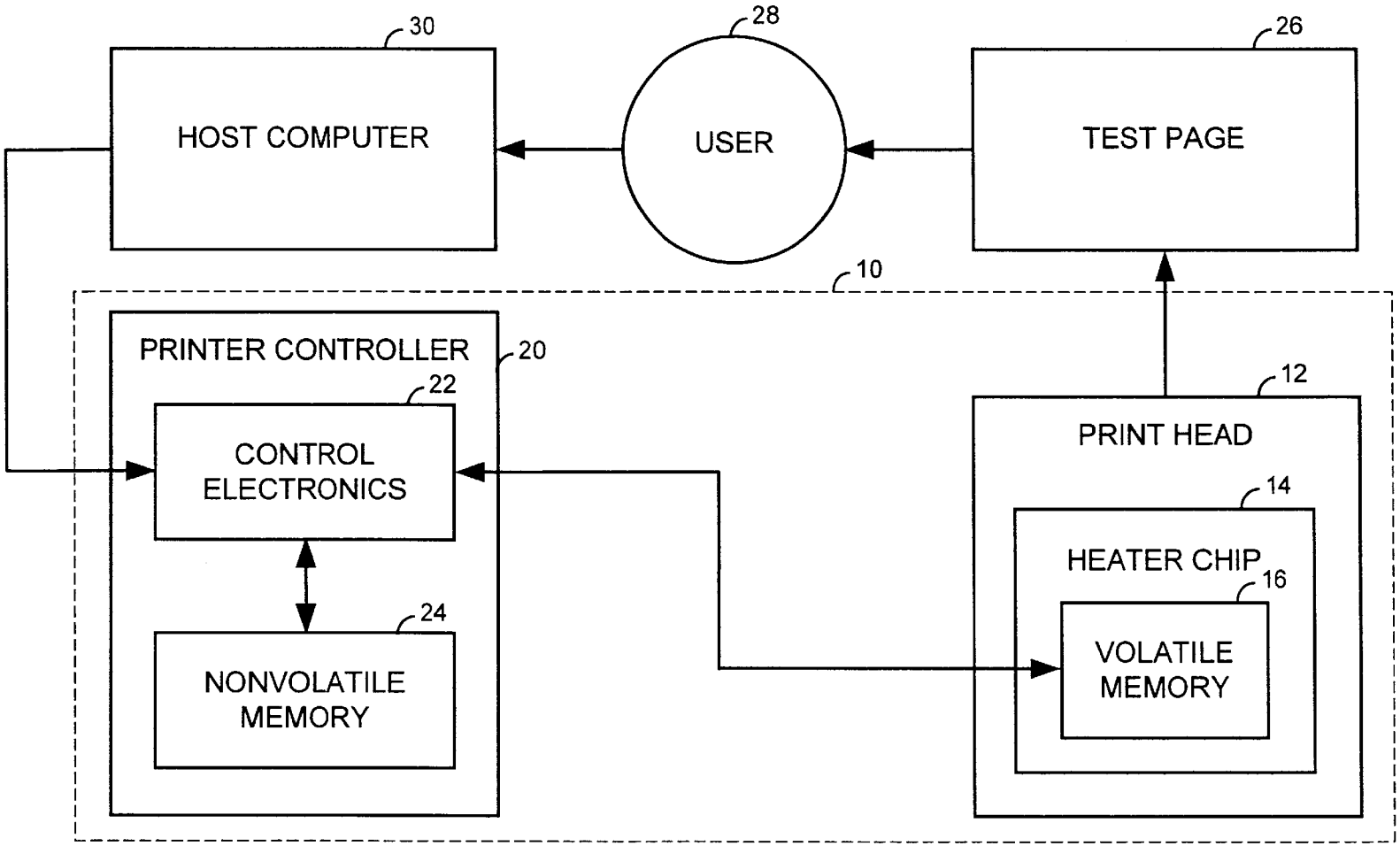
FIG. 3 is a functional block diagram of an ink jet printer which electronically compensates for misalignments between various components in the printer according to an alternative embodiment of the invention.
Figure 7:
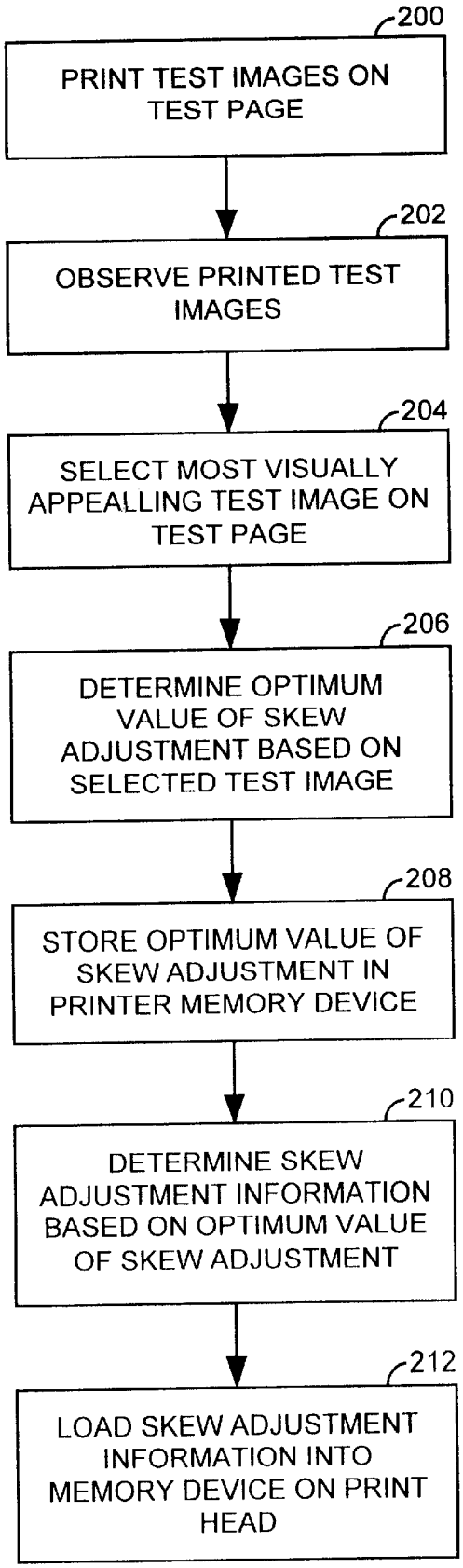
FIG. 7 is a functional flow diagram of a method for compensating for misalignments between various components in an ink jet printer according to an alternative embodiment of the invention.

In an alternative embodiment of the invention, user feedback is utilized to determine an optimum value of misalignment compensation to be applied. According to this embodiment, as depicted in FIGS. 3 and 7, the printer 10 prints a plurality of test images on a test page 26 (step 200). For each test image, a different value of alignment adjustment is applied, corresponding to different amounts of angular misalignment between the heater chip 14 and the rail 13. The user 28 observes the test images printed on the test page 26 (step 202), and selects at least one of the test images as most visually appealing in comparison with the other test images (step 204). The user 28 then enters the selection of the most appealing test image into the host computer 30, preferably by entering a number in a dialog box corresponding to the selected test image.

Based on the selected test image, the host computer 30 determines the value of alignment adjustment that was applied while printing the selected test image (step 206). This optimum value of alignment adjustment is then stored in a printer memory device (step 208), preferably the nonvolatile memory device 24 associated with the printer controller 20. Since it is preferably stored in nonvolatile memory, this alignment adjustment value is available each time the printer 10 is powered on. Thus, the test page procedure need not be performed each time the printer 10 is turned on, but is preferably performed each time a new print head 12 is installed in the printer 10.

Based on the optimum value of alignment adjustment stored in the memory 24, when a printing task is initiated, the printer controller 20 calculates skew adjustment information that includes compensation for the misalignment (step 210). Preferably, this skew adjustment information is loaded into the volatile memory device 16 on the ink jet heater chip 16 (step 212).

The skew adjustment information determined during the user feedback procedure depicted in FIG. 3 preferably takes into account misalignments between the rail 13 and the carriage 11, between the carriage 11 and the print head 12, and between the print head 12 and the heater chip 14. Thus, the procedure determines one alignment adjustment value to compensate for all of these misalignment components. Since this embodiment requires only one nonvolatile memory device to store the skew adjustment information, that memory device could be the device 24 located in the printer body or could be the device 18 located on the print head 12.

Figure 4:
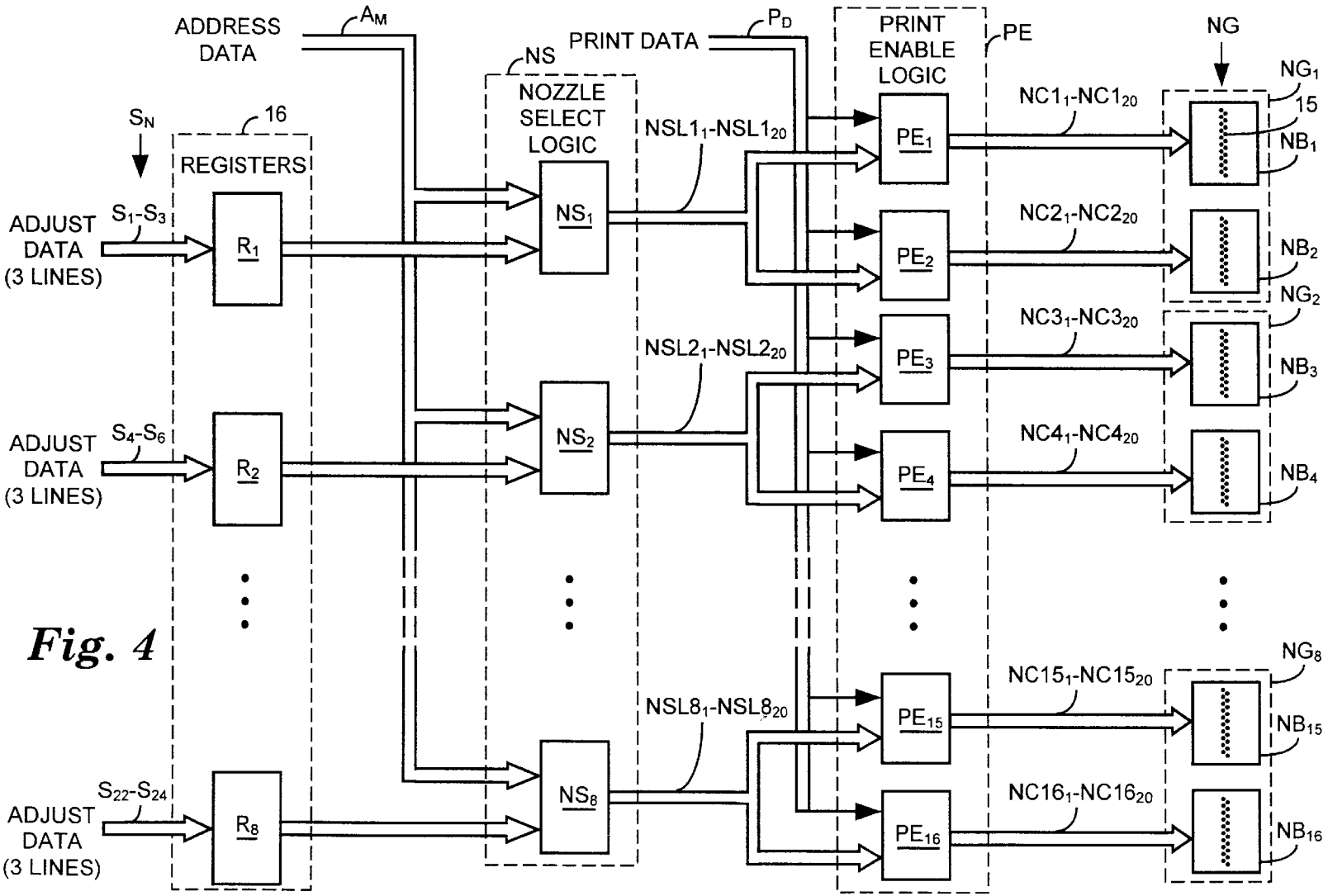
FIG. 4 depicts memory devices, logic circuits, and nozzle groups used in electronically compensating for misalignments between various components in a printer according to a preferred embodiment of the invention.

Depicted in FIG. 4 are the memory registers 16, nozzle select logic circuits NS, and print enable logic circuits PE provided on the heater chip 14 to select and enable particular heating elements to cause ejection of ink from selected ones of 320 nozzles 15 which are preferably divided into eight nozzle groups $NG_1$–$NG_8$. Within each nozzle group $NG_1$–$NG_8$ of the preferred embodiment are two nozzle blocks $NB_D$, where there are preferably twenty nozzles 15 per nozzle block $NB_D$. As shown in FIG. 4, the selection and activation of particular heating elements is based upon signals provided on M number of address lines $A_M$, D number of print data lines $P_D$, and N number skew adjust data lines $S_N$. In the preferred embodiment of the invention, there are five address lines $A_1$–$A_5$ (M=5), sixteen print data lines $P_1$–$P_{16}$ (D=16), and twenty-four skew adjust data lines $S_1$–$S_{24}$ (N=24). It should be appreciated, however, that the invention is not limited to any particular number of address lines, print data lines, skew adjustment data lines, nozzle blocks, nozzle groups, or nozzles.

The memory device 16 of FIG. 4 preferably consists of eight 3-bit data registers $R_1$–$R_8$, with one corresponding to each of eight nozzle groups $NG_1$–$NG_8$. Each of the eight registers $R_1$–$R_8$ is loaded from X number of the N number skew adjust data lines $S_N$, and the skew adjustment data is stored in the registers $R_1$–$R_8$ until the printer power is turned off (step 110 of FIG. 6). In the preferred embodiment of the invention, X is equal to three. As shown in FIG. 4, the skew adjustment data bits from the registers $R_1$–$R_8$ are provided to the nozzle select logic NS where they are used to modify the address data provided on the address lines $A_M$.

Figure 5:
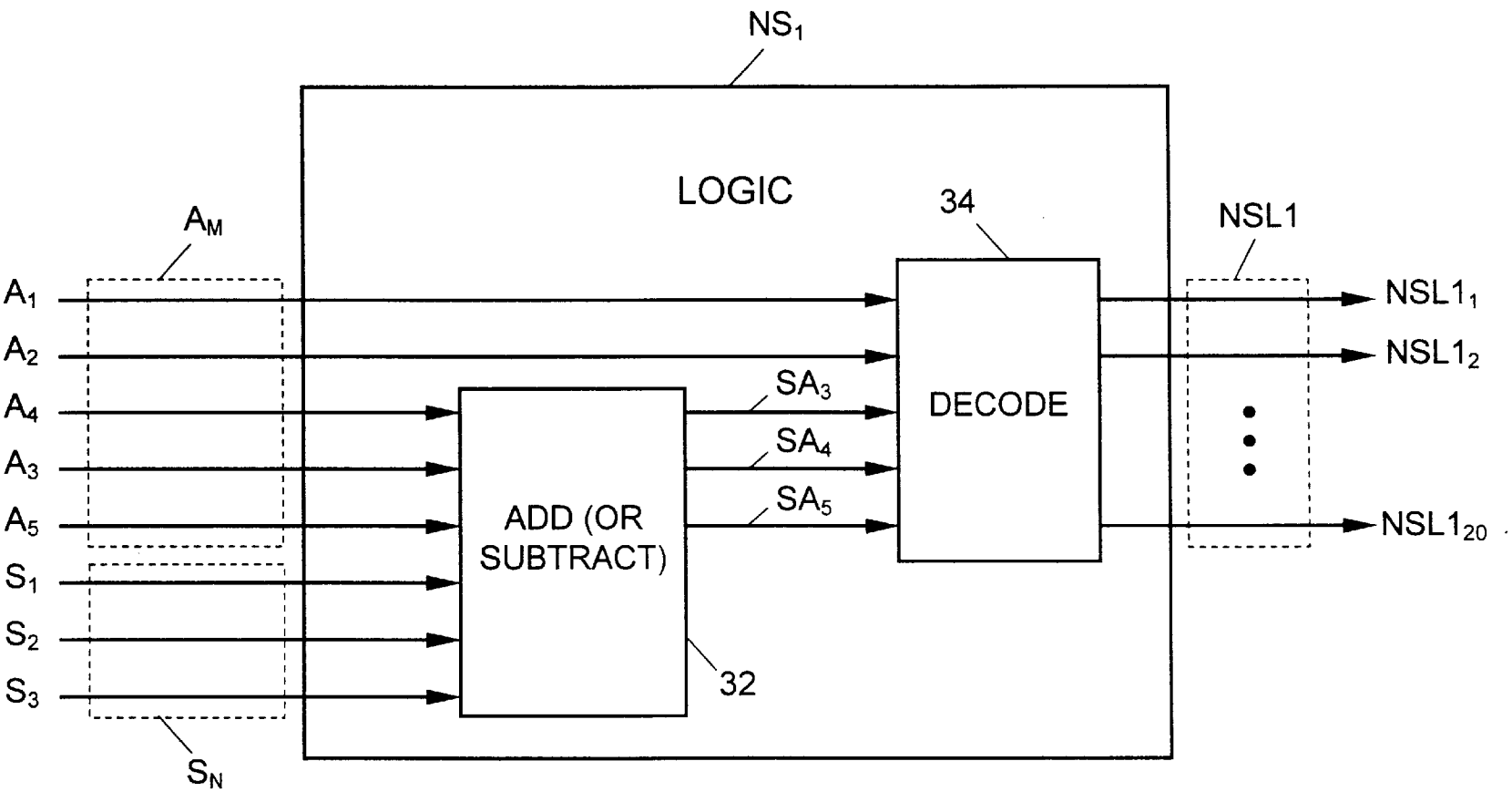
FIG. 5 depicts a logic circuit for adjusting the timing of nozzle select signals according to a preferred embodiment of the invention.

The nozzle select logic NS preferably includes eight nozzle select logic circuits $NS_1$–$NS_8$, an exemplary one of which, $NS_1$, is depicted in detail in FIG. 5. In the preferred embodiment of the invention, each of the other circuits $NS_2$–$NS_8$ are identical in structure and function to circuit $NS_1$. As shown in FIGS. 4 and 5, the three bits of skew adjust data $S_1$–$S_3$ are loaded from the memory register R1 (step 112 of FIG. 6), and the three bits of address data on the address lines $A_3$–$A_5$ are received (step 114) and logically added to the three skew adjustment data bits (step 116) in an addition logic circuit 32 to provide adjusted address bits $SA_3$–$SA_5$. The address bits on the address lines $A_1$–$A_2$ and the adjusted address bits $SA_3$–$SA_5$ are then provided to the decode circuit 34 (step 118). The decode circuit 34 decodes the five address bits $A_1$, $A_2$, $SA_3$, $SA_4$, and $SA_5$ to set a logic high signal on one of twenty nozzle select lines $NSL1_1$–$NSL1_{20}$ (step 120).

Note that in this embodiment, the carry information from the addition operation is lost. Because the carry information is lost, the data manipulation in the controller 20 is somewhat complicated, but straightforward in its implementation. Other implementations of this logic will be apparent to those skilled in the art, such as those in which the address data or skew adjust data are not encoded, or are partially encoded.

In an alternative embodiment of the invention, the circuit 32 of FIG. 5 is a subtraction logic circuit for logically subtracting the three bits of skew adjust data $S_1$–$S_3$ from the three bits of the address data on address lines $A_3$–$A_5$. As with the previously-described embodiment, the difference data bits $SA_3$, $SA_4$, and $SA_5$ are combined with the address bits $A_1$ and $A_2$ in the decode circuit 34 to select one of the twenty nozzle select lines $NSL1_1$–$NSL1_{20}$. With this embodiment, the nozzle timing adjustment is in the opposite direction from that of the previous embodiment, but the overall effect is the same. Note that the borrow information is lost from the subtraction operation.

Referring again to FIGS. 4 and 5, the print data, which is preferably fully decoded, is provided on the sixteen print data lines $P_1$–$P_{16}$ to the print enable logic block PE, where the data lines $P_1$–$P_{16}$ are distributed to the corresponding sixteen print enable logic circuits $PE_1$–$PE_{16}$ (step 122 of FIG. 6). The nozzle select lines $NSL1_1$–$NSL_{20}$ are provided to the print enable logic circuits $PE_1$, and $PE_2$, the nozzle select lines $NSL2_1$–$NSL2_{20}$ are provided to the print enable logic circuits $PE_3$ and $PE_4$, and so forth. In the print enable logic block $PE_1$, bits on the nozzle select lines $NSL1_1$–$NSL1_{20}$ are logically ANDed with data on the print data line $P_1$ to generate nozzle control signals on lines $NC1_1$–$NC1_{20}$ (step 124). Similarly, in the print enable logic block $PE_2$, the bits on the nozzle select lines $NSL1_1$–$NSL1_{20}$ are logically ANDed with data on the print data line $P_2$ to generate nozzle control signals on lines $NC2_1$–$NC2_{20}$. The twenty nozzle control signals on the lines $NC1_1$–$NC1_{20}$ are provided to the nozzle block $NB_1$ to control twenty heating elements, and the twenty nozzle control signals on the lines $NC2_1$–$NC2_{20}$ are provided to the nozzle block $NB_2$ to control another twenty heating elements (step 126). The forty nozzles in the nozzle blocks $NB_1$ and $NB_2$ comprise the nozzle group $NG_1$.

Thus, in the preferred embodiment, three skew adjust data bits, such as on adjust data lines $S_1$, $S_2$, and $S_3$, are used to adjust the timing of the forty nozzle control signals in a single nozzle group, such as $NG_1$. The number of bits of skew adjustment data per group determines the timing adjustment step size. For example, a single bit cuts the normal nozzle timing in half, two bits cuts it by a factor of four, three bits by a factor of eight, and so on. In the preferred embodiment of the invention, nozzle addressability in the horizontal (scan) axis is 300 dots per inch (dpi), and there are three skew adjustment bits (X=3) per nozzle group NG, which provides for 2400 dpi (or about 10 micron) adjustment steps. Thus, the eight nozzle groups $NG_1$–$NG_8$ of the preferred embodiment provide a total adjustment range of about 80 microns (1/300 inch).

Since the skew adjust data may change which nozzle is selected within a nozzle block, the timing of the print data must be adjusted accordingly. The adjustment of the print data timing preferably takes place in the printer control electronics 22 (FIGS. 2 and 3). In an alternative embodiment, the skew adjustment data is provided to the host computer 30 (FIG. 3), and the adjustment of the print data preferably takes place therein.

Some print head heater chips have a center-fed ink via with columns of nozzles on either side of the via. For such heater chips, the invention may be used to independently control the timing of each nozzle column. For example, an entire nozzle column could be treated as a nozzle group, and the adjustment data may be used solely for the purpose of controlling timing to account for the horizontal separation between columns.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A method for compensating for misalignments in an ink jet printer having an ink jet print head cartridge that includes a heater chip, comprising the steps of:

(a) providing a volatile memory device on the heater chip;

(b) determining alignment adjustment information related to the misalignments in the ink jet printer;

(c) loading the alignment adjustment information into the volatile memory device on the heater chip;

(d) accessing the alignment adjustment information from the volatile memory device;

(e) generating nozzle control signals based at least in part on the alignment adjustment information; and (f) selectively providing the nozzle control signals to resistive heating elements in the heater chip, thereby heating ink in ink chambers adjacent the heating elements and ejecting ink droplets toward a print medium.

2. The method of claim 1 further comprising the steps of:

(f) storing heater chip alignment information in a print head memory device disposed on the ink jet print head cartridge;

(g) storing print head alignment information in a printer memory device disposed in one of the ink jet printer and a host computer;

(h) accessing the heater chip alignment information from the print head memory device;

(i) accessing the print head alignment information from the printer memory device; and step (a) further comprising determining the alignment adjustment information based at least in part on the heater chip alignment information and the print head alignment information.

3. A method for compensating for misalignments in an ink jet printer having an ink jet print head cartridge that includes a heater chip, comprising the steps of:

(a) determining alignment adjustment information related to the misalignments in the ink jet printer;

(b) loading the alignment adjustment information into a volatile memory device on the heater chip;

(c) accessing the alignment adjustment information from the volatile memory device;

(d) receiving address information;

(e) determining nozzle select information based on the alignment adjustment information and the address information;

(f) receiving print data corresponding to an image to be printed on a print medium;

(g) generating nozzle control signals based at least in part on the nozzle select information and the print data; and (h) selectively providing the nozzle control signals to resistive heating elements in the heater chip, thereby heating ink in ink chambers adjacent the heating elements and ejecting ink droplets toward a print medium.

4. The method of claim 3 wherein:

step (c) further comprises accessing X number of bits of alignment adjustment data from the volatile memory device;

step (d1) further comprises receiving a first portion of M number of bits of address data, the first portion comprising X number of the M number of bits of address data; and step (d2) further comprises:

(d21) adding the X bits of the alignment adjustment data to the X bits of the address data to form X bits of sum data;

(d22) receiving a second portion of the M number of bits of address data, the second portion comprising M−X bits of the address data not included in the first portion; and (d23) generating the nozzle select information based on the X bits of sum data and the second portion of the address data.

5. The method of claim 3 wherein:

step (c) further comprises accessing X number of bits of alignment adjustment data from the volatile memory device;

step (d1) further comprises receiving a first portion of M number of bits of address data, the first portion comprising X number of the M number of bits of address data; and step (d2) further comprises:

(d21) determining a difference of the X bits of the alignment adjustment data and the X bits of the address data to form X bits of difference data;

(d22) receiving a second portion of the M number of bits of address data, the second portion comprising M−X bits of the address data not included in the first portion; and (d23) generating the nozzle select information based on the X bits of difference data and the second portion of the address data.

6. A method for compensating for misalignments in an ink jet printer having an ink jet print head cartridge that includes a heater chip, comprising the steps of:

(a) storing heater chip alignment information in a print head memory device disposed on the ink jet print head cartridge;

(b) storing print head alignment information in a printer memory device disposed in the ink jet printer;

(c) accessing the heater chip alignment information from the print head memory device;

(d) accessing the print head alignment information from the printer memory device;

(e) determining alignment adjustment information based at least in part on the heater chip alignment information and the print head alignment information;

(f) loading the alignment adjustment information into a heater chip memory device;

(g) accessing the alignment adjustment information from the heater chip memory device;

(h) receiving address information;

(i) determining nozzle select information based on the alignment adjustment information and the address information;

(j) receiving print data corresponding to an image to be printed on a print medium; and (k) generating nozzle control signals based at least in part on the nozzle select information and the print data; and (l) selectively providing the nozzle control signals to resistive heating elements in the heater chip, thereby heating ink in ink chambers adjacent the heating elements and ejecting ink droplets toward a print medium.

7. An ink jet printer for forming printed images on a print medium based on print data, the printer comprising:

a carriage movable in a first direction relative to the print medium;

an ink jet print head cartridge including:

a cartridge housing mechanically coupled to the carriage, the cartridge housing oriented with respect to the carriage according to a print head alignment angle;

an ink jet heater chip oriented with respect to the cartridge housing according to a heater chip alignment angle, the ink jet heater chip having:

an array of resistive ink-heating elements; and a heater chip memory device for receiving alignment adjustment information; and an array of nozzles corresponding to the array of ink-heating elements through which ink is ejected toward the print medium;

a print head memory device for storing heater chip alignment information related to the heater chip alignment angle;

a printer controller comprising:

a printer memory device for storing print head alignment information related to the print head alignment angle; and control electronics electrically coupled to the heater chip memory device, the print head memory device, and the printer memory device, the control electronics for accessing the print head memory device to retrieve the heater chip alignment information, for accessing the printer memory device to retrieve the print head alignment information, for determining the alignment adjustment information based at least in part on the heater chip alignment information and the print head alignment information, and for providing the alignment adjustment information to the heater chip memory device.

8. An ink jet printer for forming printed images on a print medium based on print data, the printer comprising:

a carriage movable in a first direction relative to the print medium;

an ink jet print head cartridge including:

a cartridge housing mechanically coupled to the carriage, the cartridge housing oriented with respect to the carriage according to a print head alignment angle;

an ink jet heater chip oriented with respect to the cartridge housing according to a heater chip alignment angle, the ink jet heater chip having:

an array of resistive ink-heating elements;

a heater chip memory device for receiving alignment adjustment information;

a nozzle select logic circuit electrically coupled to the heater chip memory device for receiving the alignment adjustment information, for receiving address information, and for generating nozzle select information based on the alignment adjustment information and the address information; and a print enable logic circuit electrically coupled to the nozzle select logic circuit for receiving the nozzle select information, for receiving print data, and for generating print enable signals based on the nozzle select information and the print data;

an array of nozzles corresponding to the array of ink-heating elements through which ink is ejected toward the print medium; and a print head memory device for storing heater chip alignment information related to the heater chip alignment angle; and a printer controller comprising:

a printer memory device for storing print head alignment information related to the print head alignment angle; and control electronics electrically coupled to the heater chip memory device, the print head memory device, and the printer memory device, the control electronics for accessing the print head memory device to retrieve the heater chip alignment information, for accessing the printer memory device to retrieve the print head alignment information, for determining the alignment adjustment information based at least in part on the heater chip alignment information and the print head alignment information, and for providing the alignment adjustment information to the heater chip memory device.

9. The ink jet printer of claim 8 wherein the nozzle select logic circuit receives the address information as address data comprising M number of bits, the nozzle select logic circuit further comprising:

an addition logic circuit electrically coupled to the heater chip memory device for receiving therefrom the alignment adjustment information as X number of bits, for receiving a first portion of the address data comprising X of the M bits of address data, and for adding the X bits of the alignment adjustment data to the X bits of the address data to form X bits of sum data; and a decode logic circuit electrically coupled to the addition logic circuit for receiving therefrom the X bits of sum data, for receiving a second portion of the address data comprising M−X bits of the address data not included in the first portion, and for generating the nozzle select information based on the X bits of sum data and the M−X bits of the address data.

10. The ink jet printer of claim 8 wherein the nozzle select logic circuit receives the address information as address data comprising M number of bits, the nozzle select logic circuit further comprising:

a subtraction logic circuit electrically coupled to the heater chip memory device for receiving therefrom the alignment adjustment information as X number of bits, for receiving a first portion of the address data comprising X of the M bits of address data, and for determining a difference of the X bits of the alignment adjustment data and the X bits of the address data to form X bits of difference data; and a decode logic circuit electrically coupled to the subtraction logic circuit for receiving therefrom the X bits of difference data, for receiving a second portion of the address data comprising M−X bits of the address data not included in the first portion, and for generating the nozzle select information based on the X bits of difference data and the M−X bits of the address data.

11. A method for compensating for misalignments in an ink jet printer having an ink jet print head that includes a heater chip, comprising the steps of:

(a) printing a plurality of test images on a test page using the ink jet printer while applying different values of skew adjustment during the printing of each of the test images;

(b) observing the test images printed on the test page;

(c) selecting at least one of the test images as most visually appealing in comparison with other of the test images;

(d) determining at least one optimum value of skew adjustment based on the at least one test image selected in step (c);

(e) storing the at least one optimum value of skew adjustment in a printer memory device;

(f) determining skew adjustment information based at least in part on the optimum value of skew adjustment stored in the printer memory device; and (g) loading the skew adjustment information into a memory device on the ink jet print head.

* * * * *